US009392887B2

(12) United States Patent
Nilsson

(10) Patent No.: US 9,392,887 B2
(45) Date of Patent: Jul. 19, 2016

(54) PRODUCT DIVIDER FOR SHELF UNITS

(71) Applicant: Rickard Nilsson, Balduinstein (DE)

(72) Inventor: Rickard Nilsson, Balduinstein (DE)

( * ) Notice: Subject to any disclaimer, the term of this patent is extended or adjusted under 35 U.S.C. 154(b) by 0 days.

(21) Appl. No.: 14/428,391

(22) PCT Filed: Sep. 17, 2012

(86) PCT No.: PCT/DE2012/100285
§ 371 (c)(1),
(2) Date: Mar. 16, 2015

(87) PCT Pub. No.: WO2013/037368
PCT Pub. Date: Mar. 21, 2013

(65) Prior Publication Data

US 2015/0223620 A1 Aug. 13, 2015

(51) Int. Cl.
*A47F 5/00* (2006.01)
*A47B 57/58* (2006.01)

(52) U.S. Cl.
CPC ..... *A47F 5/005* (2013.01); *A47B 57/58* (2013.01)

(58) Field of Classification Search
CPC ..... A47F 5/105; A47F 57/58; A47F 5/005; A47F 57/588; A47F 5/132; A47F 3/14; A47F 5/0025; A47F 7/144; A47F 5/00; A47B 96/04; A47B 96/021; A47B 65/15
USPC ..... 211/184, 134, 135, 59.2, 59.3, 59.4, 211/126.12, 126.2; 108/61, 60; 220/532, 220/533, 552
See application file for complete search history.

(56) References Cited

U.S. PATENT DOCUMENTS 1,450,191 A 4/1923 Sturm
1,523,136 A * 1/1925 O'Connor ..... B25H 3/06 206/558
1,748,339 A * 2/1930 Gerberich ..... A47B 57/58 108/61
2,781,125 A * 2/1957 Lawrence ..... G03B 21/54 206/425
2,788,912 A * 4/1957 Simonsen ..... B65D 25/06 220/533
2,843,131 A * 7/1958 Wolters ..... A47B 57/58 220/531
2,915,193 A * 12/1959 Bromberg ..... A47F 5/005 108/61
3,067,903 A * 12/1962 Jones, Jr. ..... A47B 88/20 206/818
3,269,558 A * 8/1966 Hess ..... A47B 57/58 211/184
4,084,699 A * 4/1978 Koepke ..... B42F 17/12 211/11
4,190,167 A * 2/1980 Wells ..... A47F 5/005 108/61
4,858,774 A * 8/1989 Winter ..... A47B 96/04 108/61
5,553,710 A * 9/1996 Takama ..... A47B 88/20 206/561
6,047,647 A * 4/2000 Laraia, Jr. ..... A47F 5/005 108/61

(Continued)

FOREIGN PATENT DOCUMENTS

GB 1180111 A 2/1970

*Primary Examiner* — Joshua Rodden
*Assistant Examiner* — Hiwot Tefera
(74) *Attorney, Agent, or Firm* — Leydig, Voit & Mayer, Ltd.

(57) ABSTRACT

A product divider has at least two material sections, which project from a main body and of which material sections at least one can be inserted into at least one first opening in a side wall of a shelf and the other material section can be inserted into at least one second shelf opening to fix the product divider in a shelf position, wherein the material section associated with the first shelf opening, has an outside length dimensioned such that, after its insertion into the first opening and subsequent movement of the product divider against the insertion direction to bring the other material section into an operative position relative to the second opening, the material section remains inserted into the first opening when the product divider has assumed the fixed shelf position.

17 Claims, 4 Drawing Sheets

(56) References Cited

U.S. PATENT DOCUMENTS 6,098,821 A * 8/2000 Dube ..... A47B 57/588 211/184
6,805,250 B2 * 10/2004 Ondrasik ..... A47F 5/005 211/184
8,251,233 B1 * 8/2012 Biglow ..... A47F 1/12 211/187
8,893,903 B2 * 11/2014 Nilsson ..... A47B 57/588 211/134
8,915,381 B2 * 12/2014 Brozak ..... A47F 7/0021 108/61
8,950,113 B1 * 2/2015 Schall ..... B65D 19/18 220/533
2003/0034319 A1 * 2/2003 Meherin ..... A47F 5/005 211/184
2005/0115972 A1 * 6/2005 Osborn ..... B07C 3/008 220/533
2006/0260518 A1 * 11/2006 Josefsson ..... A47F 5/005 108/61
2010/0258513 A1 * 10/2010 Meyer ..... A47F 5/005 211/59.3
2013/0153524 A1 * 6/2013 Nilsson ..... A47B 57/588 211/153

* cited by examiner

PRODUCT DIVIDER FOR SHELF UNITS

CROSS-REFERENCE TO RELATED APPLICATIONS

This application is a U.S. National Stage application under 35 U.S.C. §371 of International Application No. PCT/DE2012/100285, filed on Sep. 17, 2012. The International Application was published in German on Mar. 21, 2013, as WO 2013/037368 A1 under PCT Article 21(2).

FIELD

The invention relates to a product divider for shelf units, in particular retail shelf units. The invention also relates to such a shelf unit or retail shelf unit.

BACKGROUND

Product dividers serve to separate products from other products that are arranged on a shared shelf of a shelf unit. In the case of shelf units such as, for example, retail shelf units in which products of the same type are arranged one behind the other, the product divider also serves to retain the intended sorting of the products.

Particularly with retail shelf units that are configured as so-called sliding shelf units, the product divider serves as a guide by means of which the lined-up products are guided laterally. Thanks to the product dividers, the products execute a controlled sliding movement that is brought about by the slanted position of the shelf in the sliding shelf units and that occurs when the front-most product is removed. Thus, the product divider or two product dividers situated at the sides prevent the product from slipping out of the row sideways.

The product divider is normally attached to a front area and to a rear area of a tray, for example, to a shelf or to a shelf that is configured as a product slide plate. In so-called product slide plates, which usually have a front and rear upward lip, the product divider is usually attached to the front and rear upward lips.

Prior-art product dividers often call for special tools in order to be installed on the shelf unit. Then, dismantling the product divider is usually only possible with such a tool. Consequently, the installation of the product divider within the scope of the first-time set-up of a shelf unit is still possible since the tool is normally provided with the shelf unit. However, a quick rearrangement of the product dividers later on is usually difficult since the tool is often no longer on hand.

SUMMARY

An aspect of the invention provides a product divider for a shelf unit, comprising: a main body configured to separate one or more products and including at least two material sections that project outwards from the main body; locking elements configured to lock the product divider with a positive fit onto a tray in a fixed position, wherein at least one of the material sections can be inserted into at least one first opening of a side wall of the tray, wherein the other material section can be inserted into at least one second opening of the tray so as to hold the product divider in the fixed position on the tray, wherein an outward-facing length of the material section that can be associated with the first opening of the tray is dimensioned such that, after the material section has been inserted into the first opening and after the product divider has subsequently been moved back opposite to an insertion direction to move the other material section into an active position relative to the second opening, the material section remains inserted in the first opening when the product divider has assumed the fixed position on the tray.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
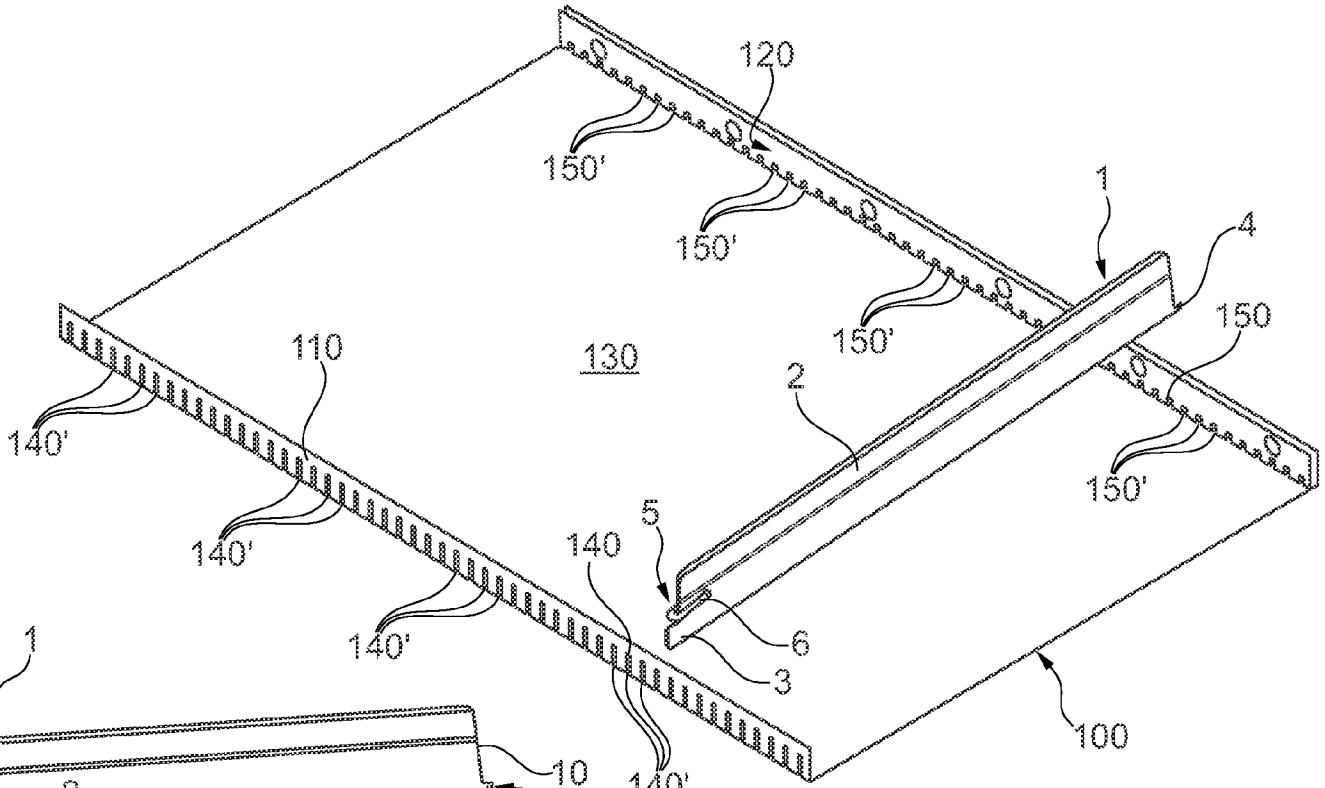
FIGS. 1A and 1B a possible embodiment of a product divider according to the invention and a possible embodiment of a tray in a perspective view (FIG. 1A) and in a side view (FIG. 1B), whereby the product divider is in a position in which it has not yet been installed on the tray, and FIGS. 2A and 2B the product divider and the tray according to FIGS. 1A and 1B in a perspective view (FIG. 2A) and in a side view (FIG. 2B), whereby the product divider is in a first installed position on the tray, FIGS. 3A and 3B the product divider and the tray according to FIGS. 1A and 1B in a perspective view (FIG. 3A) and in a side view (FIG. 3B), whereby the product divider is in a second installed position on the tray, and FIGS. 4A and 4B the product divider and the tray according to FIGS. 1A and 1B in a perspective view (FIG. 4A) and in a side view (FIG. 4B), whereby the product divider is in the final installed position on the tray.

An aspect of the invention provides a product divider having the above-mentioned features that can be installed on the shelf unit in a simple manner without tools and that can be securely held on the shelf unit once it has been installed. Moreover, a shelf unit is to be put forward that is suitable for the installation of such a product divider.

A product divider according to the invention for shelf units or shelf systems, especially retail shelf units, has a main body that serves to separate the products and it has at least two material sections that project outwards from the main body or towards the outside, and at least one of the material sections can be inserted into at least one first opening of a side wall of a tray and the other material section can be inserted into at least one second opening of the tray in order to hold the product divider in a fixed position on the tray. The outward-facing length of the material section that can be or is associated with the first opening of the tray is dimensioned in such a way that, after the material section has been inserted into the first opening and after the product divider has subsequently been moved back opposite to the insertion direction in order to move the other material section into the active position relative to the second opening, the material section remains inserted in the first opening, in other words, so that it is still inserted when the product divider has assumed the fixed position on the tray.

With this embodiment, the product divider can be installed on the shelf unit in a technically simple manner, for example, with just one hand, and can be dismantled in the same way without there being a need for a tool.

The systematically dimensioned length of the one material section ensures that the product divider can be removed from the tray at any time by moving the product divider in the opposite manner from the movement during the installation in the shelf unit, so that the one material section of the product divider is disengaged from the second opening, and subsequently the other material section is disengaged from the first opening in the tray.

The tray that interacts with the product divider can consist of the shelf and a rear wall and/or a front wall of a shelf compartment. The tray can also be made up of a product slide plate, particularly a product sliding sheet, that is placed onto the bottom of a shelf compartment, whereby the product slide plate has a front, upturned edge and/or a rear, upturned edge that forms the at least one side wall of the tray.

Moreover, according to the invention, locking means are provided that lock the product divider with a positive fit onto the tray in the fixed position.

This ensures that the product divider installed on the shelf unit permanently remains on the shelf unit in its fixed position. The product divider installed on the shelf unit in a simple manner and without tools is mechanically locked by the locking means so that it cannot be detached. Even under the forces that act on the product divider, for example, when the shelf is being stocked or when the products are sliding down along the product divider, this locking means prevents the product divider from being detached from the tray.

According to a first embodiment of the invention, it is provided that the locking means are configured to engage in a space that, in the fixed position, is formed between the main body of the product divider and the side wall of the tray that has the first opening. In this manner, it is technically simple to lock the product divider with a positive fit onto the tray, without this interfering with the product separation function of the main body.

According to a preferred embodiment of the invention, it is provided that the locking means have or are made up of at least one latching element that is rotatably mounted on the product divider, particularly on the main body, and that can rotate from a starting position into a locked position that locks the product divider onto the tray in the fixed position. Thanks to the latching element that is configured as a rotating latch, it is very easy for service personnel to mechanically latch the product divider onto the shelf unit or onto the tray, thereby securing the product divider against being inadvertently detached from the shelf unit.

As a result, the product divider can be inserted into as well as removed from the shelf unit by a person using just one hand. This also makes it easy to clean.

For example, when the product divider is in the fixed position, the latching element can be moved upwards in order to reach the starting position, or else it can be moved downwards in order to move from the starting position or from an intermediate position into the locked position. The starting position is preferably an unlocked position in which a mechanical locking by the latching element does not take place.

Preferably, the latching element is configured in such a way that, in its locked position, it engages in the space between the main body of the product divider and the side wall of the tray that has the first opening.

It lends itself for the latching element to be configured in such a way that, when it is in the locked position, it is in contact with one of the material sections and/or with one end face of the main body. In this manner, the latching element is in the locked position in a defined position so that the service personnel can immediately recognize visually or by feel whether the product divider is mechanically locked onto the shelf unit.

The latching element can be configured, for example, as a bracket, especially an oval bracket, ring or clamp, that can turn and pass through a passage opening in the product divider, especially in the main body of the product divider. The passage opening can be a bore, a hole, a slot or a rail.

According to another embodiment of the invention, it is provided that the material sections are shaped onto the main body, especially by removing material or by separating material from a blank that forms the main body. In this manner, the material sections can be made simply and cost-effectively.

Another embodiment of the invention consists in that the material sections are configured differently from each other in terms of the shape, contour and/or surface area of the cross section. This results in an unmistakable installed position of the product divider onto the shelf unit or onto the tray, thereby facilitating the proper installation by service personnel.

For example, the cross section surface area of the material section that can be inserted into the first opening in the side wall can be larger than that of the other material section. Moreover, due to the larger cross section surface area, a sturdier connection is established between the product divider and the side wall, so that the product divider can withstand greater forces in the area of the side wall.

It lends itself for the material section that can be inserted into the first opening of the tray to have an essentially rectangular cross section, especially a square cross section, so that it can be inserted into the first opening that has an angular, especially slot-shaped configuration. Consequently, the material section of the product divider that was the first to be inserted into the first opening in the side wall is already held non-rotatably in the first passage opening, so that the further installation steps are easier for the service personnel. As a result, within the scope of the installation into the second opening, the product divider can only still be moved in the axial direction, thereby simplifying the insertion of the product divider into the second opening in the tray.

It lends itself for the cross section shape of the material section and for the shape of the first opening to be configured so as to essentially match each other. In this manner, the material section is held in the first opening virtually without play or at least with only a relatively small amount of play. Preferably, the cross section shape of the other material section and the shape of the second opening essentially match each other. This effectively prevents a sloppy appearance of the product divider installed on the shelf unit, thus improving the overall appearance of the shelf unit that is fitted with product dividers. This also facilitates handling during the stocking of the shelf unit and the removal of products from the shelf unit since a bothersome movement of the product divider cannot occur when it is in its installed position on the shelf.

The material section that can be inserted into the second opening can have an essentially angular, especially polygonal cross section, especially a rectangular or square cross section. It is also conceivable for the material section to have a round, especially circular or oval cross section.

According to another embodiment of the invention, it is provided for the product divider to have an elongated shape and especially for one of each of the material sections to be arranged on one of the two end faces of the product divider, especially in the area of one end section of the appertaining end face, said end section facing the bottom of the tray. In this manner, in a simple way, the product divider can be mechanically locked to the shelf unit since, in the installed state of the product divider, there is a space above at least one of the material sections between the product divider and the side wall of the tray with which the locking means can engage. If the material section extends to the underside of the product divider, the side of the product divider that comes into contact with the bottom of the tray is lengthened by the at least one material section or by both material sections.

According to another embodiment of the invention, the product divider, especially at least the main body, has a plate-like configuration. This translates into a separating function of the product divider for numerous products of varying sizes. Even with relatively small products, the products arranged in a row are prevented from slipping sideways since the full-surface configuration of the product divider keeps even these small products lined up.

Of course, the main body of the product divider can also be configured as at least one bracket at whose ends, for example, the material sections are each arranged.

It lends itself for the product divider to be made of metal, plastic, wood or a similar dimensionally stable material. This ensures an optimal separating function of the product divider, even in the case of relatively heavy products and relatively strong forces acting on the sides. It is also ensured that, in such cases, the product divider remains securely held on the shelf unit since this prevents a deformation of the product divider, which would detrimentally affect its function.

The product divider can be made, for example, of stainless steel, which allows it to be used in freezers as well as in the medical and food sectors. Consequently, depending on the material employed, it can be used in the household realm, in retail and/or in industry.

In one embodiment, the product divider according to the invention can have the features that the product divider is made of a dimensionally stable and/or sturdy material such as metal, plastic or wood, and that it has a basic shape that has a smaller extension on one lower side, whereby this extension fits into circular, oval, rectangular and/or square openings of the tray, and that it has a larger perpendicular extension on its other lower side, whereby this extension fits into the opposite rectangular openings of the tray, whereby the basic length with the extensions on the lower side matches the tray and is configured there to be longer than the basic length of the product divider on the upper side, and whereby the product divider has an opening at one end into which a bracket, an oval bracket, ring or clamp made of a dimensionally stable or strong material such as metal, plastic or wood is incorporated, and is configured to be movable upwards and downwards on the outside and has a size and diameter that are configured in such a way that, when in contact with the extension, the product divider plate is extended by the difference of the length between the product divider plate on the upper side and on the tray.

Moreover, the invention comprises a shelf unit with at least one tray and several product dividers of the type described above installed on it.

Additional objectives, advantages, features and application possibilities of the present invention ensue from the description below of an embodiment with reference to the drawing. In this context, all of the described and/or depicted features, either on their own or in any meaningful combination, constitute the subject matter of the present invention, also irrespective of their compilation in the claims or in the claims to which they refer back.

Figure 1B:
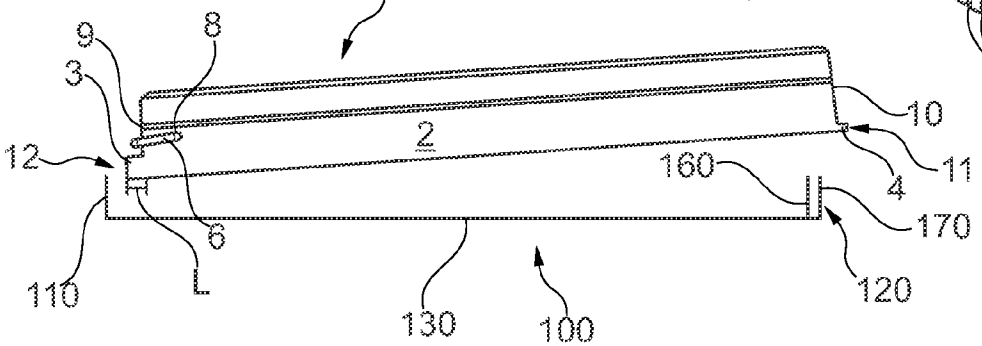

FIGS. 1A and 1B show a schematic view of a product divider 1 and a tray 100 in a perspective view (FIG. 1A) as well as in a side view (FIG. 1B), whereby the product divider 1 has not yet been installed on the tray 100.

The tray 100 is a component of a shelf unit that is to be set up in a supermarket or gas station or some similar sales venue. The tray 100 has two side walls 110 and 120 that are opposite from each other and that are connected to each other by a bottom 130. The side wall 110 has a plurality of passage openings 140', whereby adjacent openings 140' are arranged at a distance from each other, preferably at a distance of the same size. The openings 140' preferably have a contour that is the same for all of them, and they are configured, for example, to be slot-like.

Preferably, the side wall 120 likewise has a plurality of passage openings 150', whereby adjacent openings 150' are arranged at a distance from each other, preferably at a distance of the same size.

Preferably, the openings 150' are arranged at equal distances from each other, corresponding to the distance between the openings 140'.

The surface area of the openings 150' is smaller than the surface area of the openings 140', and they have an angular or round contour.

As can be seen in FIG. 1A, the openings 140' and the openings 150' each start from the bottom 130 and extend along their side walls 110, 120 vertically upwards.

The side walls 110 and 120 form the front end and the back end of the tray 100, whereby preferably the side wall 110 with its openings 140' forms the front end, whereas the side wall 120 with its openings 150' forms the back end. The side wall 120 can be configured as a double wall with an inner side wall 160 and an outer side wall 170, which are at a distance from each other.

The tray 100 is shown in FIGS. 1A and 1B by way of an example as a product slide plate with upright edges at the sides, whereby the edges form the side walls 110 and 120, and the product slide surface forms the bottom 130. The edges can be formed, for example, by a shaping procedure such as bending. It is also possible for the edges to be welded onto the slide plate. The edges are essentially perpendicular to the product slide plate. It is also conceivable for the bottom 130 to be formed by a shelf of a shelf compartment and for the side walls 110 and 120 to form the side wall of the shelf compartment.

The product divider 1 is an elongated component that has a main body 2 whose end faces 9 and 10, which are arranged in the lengthwise direction, are each adjoined by a material section 3 and 4 that is especially shaped onto the main body 2. The material sections 3 and 4 project away from the main body 2 towards the outside, whereby the material section 3 is configured so that it can be inserted into the openings 140' and the material section 4 is configured so that it can be inserted into the openings 150' of the tray 100.

As can especially be seen in FIG. 1B, the material sections 3 and 4 are formed in the area of an end section 11 and 12 of the appertaining end face 9 or 10 of the product divider 1 or of the main body 2 facing the bottom 130 of the tray 100. Preferably, the material sections 3 and 4 form an extension of the lower edge of the main body 2 on which the product divider 1 can be placed at the bottom 130 of the tray 100.

As can be seen in FIG. 1A, the main body 2 is configured to be plate-like, whereby the cross section contour of the material sections 3 and 4 matches the plate-like configuration of the main body 2.

As can also be seen in FIGS. 1A and 1B, locking means 5 are arranged on the product divider 1 and they serve to positively latch the product divider onto the tray 100.

The locking means 5 are preferably formed by a latching element 6 such as, for example, a closed ring, that is rotatably mounted on the product divider 1, especially on the main body 2. Preferably, the latching element 6 can be rotated to such an extent that it can be supported on the upper side of the material section 3 or on the end face 9 of the main body 2. The rotatable bearing of the latching element 6 can be formed by a passage opening 8 on the product divider 1, especially on the main body 2, into which opening the latching element 6 rotatably engages.

The technique during the installation of the product divider 1 on the tray is explained below with reference to FIGS. 1A and 1B through FIGS. 4A and 4B.

As shown in FIGS. 1A and 1B, the product divider 1 is placed into a first position above the tray 100 and subsequently its material section 3 is first inserted into a selected first opening 140 among the openings 140'. The product divider 1 is inserted into the first opening 140 so far that the lower lengthwise side of the product divider 1 can be placed completely at the bottom, and in a next step, it is put in place in this manner.

Figure 2A:
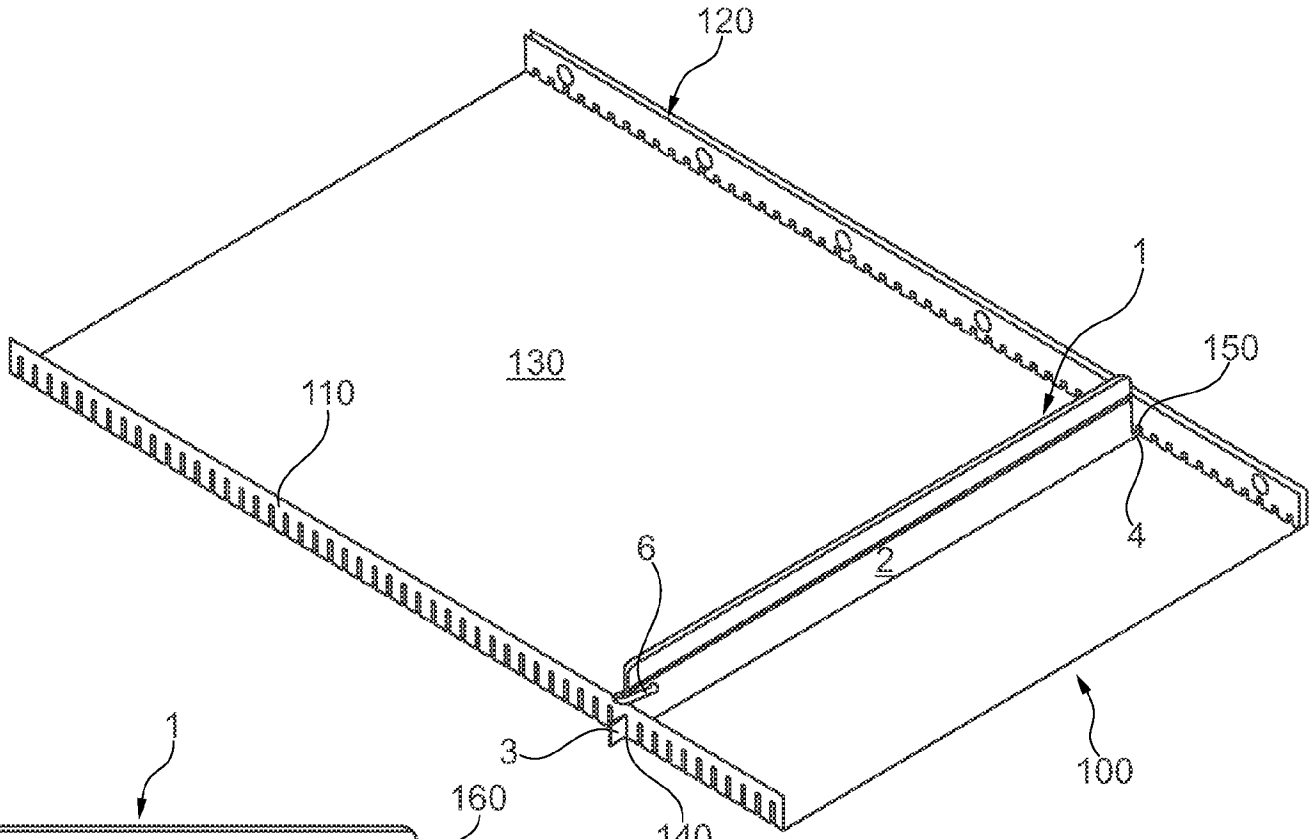
Figure 2B:
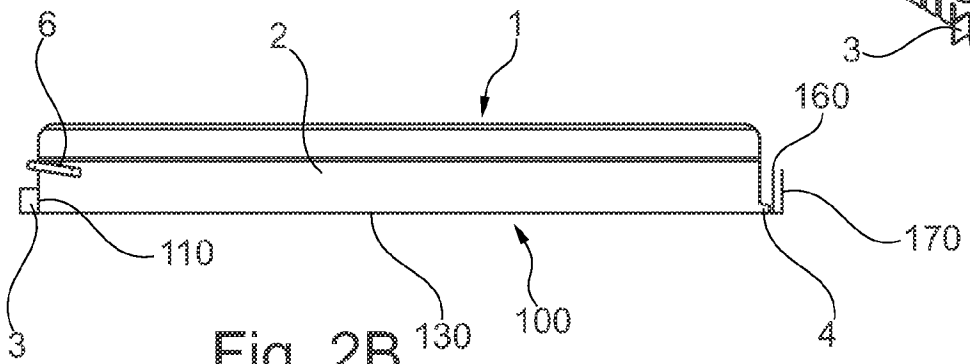

FIGS. 2A and 2B show the product divider 1 and the tray 100 in this state.

Preferably, the material section 3 is inserted so far into the first opening 140 that the end face 9 of the main body 2 comes into contact with the side wall 110.

In another step, the product divider 1 is then moved back opposite to the insertion direction so that the material section 4 is inserted into a selected second opening 150 among the openings 150', whereby the material section 3 still remains inserted in the first opening 140.

Preferably, the product divider 1 is moved back until the end face 10 of the main body 2 comes into contact with the inner side wall 160. The length L of the material section 3 is dimensioned in such a way that, when the main body 2 is in the contact position on the inner side wall 160, the material section 3 still remains inserted in the first opening 140.

Figure 3A:
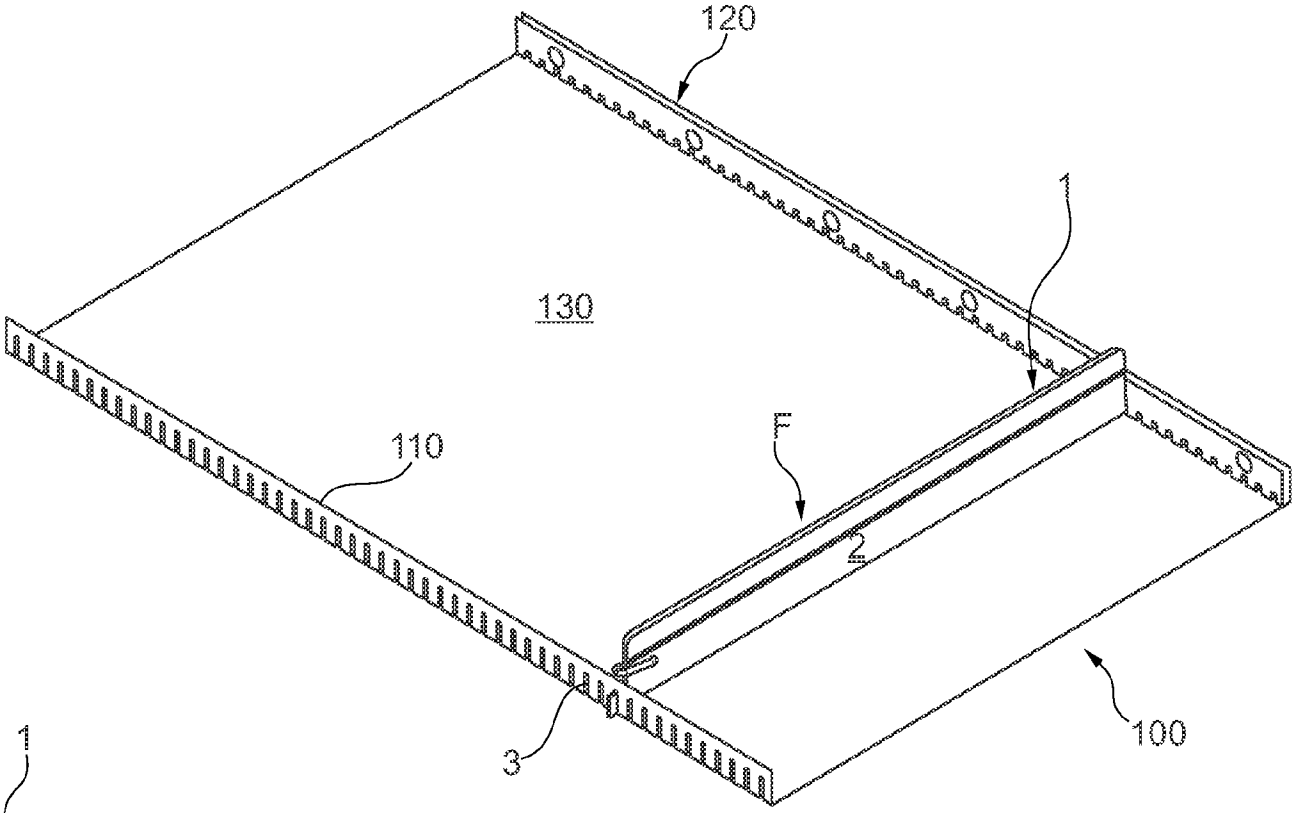
Figure 3B:
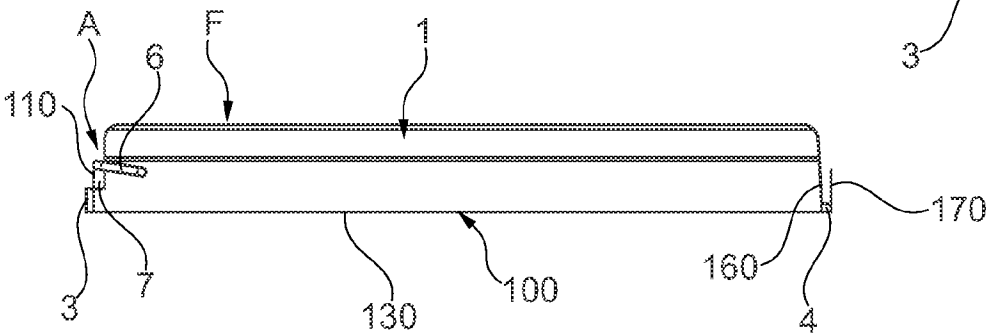

In the current position of the product divider 1 on the tray 100, as can be seen in FIGS. 3A and 3B, the product divider 1 is in a fixed position F. In the fixed position F, a space 7 is formed between the side wall 110 and the end face 9 of the main body 2, as can be seen especially clearly in FIG. 3B.

Preferably, the length of the main body 2 with the material section 3 associated with the side wall 110 is greater than the distance between the side wall 120 or the inner side wall 160 and the side wall 11 so that, when the material section 3 is in the fixed position F, it still projects out of the opening 140.

Preferably, the length of the material section 4 is essentially the same as or slightly smaller than the distance between the inner side wall 160 and the outer side wall 170.

In order to hold the product divider 1 in the fixed position F and to secure it from coming loose, the latching element 6 can be turned from an upper starting position in the downward direction into the space 7 in which the latching element 6 is in a locked position S, thereby locking the product divider 1 against shifting and securing it with a positive fit between the side walls 110 and 120. In the upper starting position, the latching element 6 is still disengaged from the space 7 and is thus in its unlatched position.

Figure 4A:
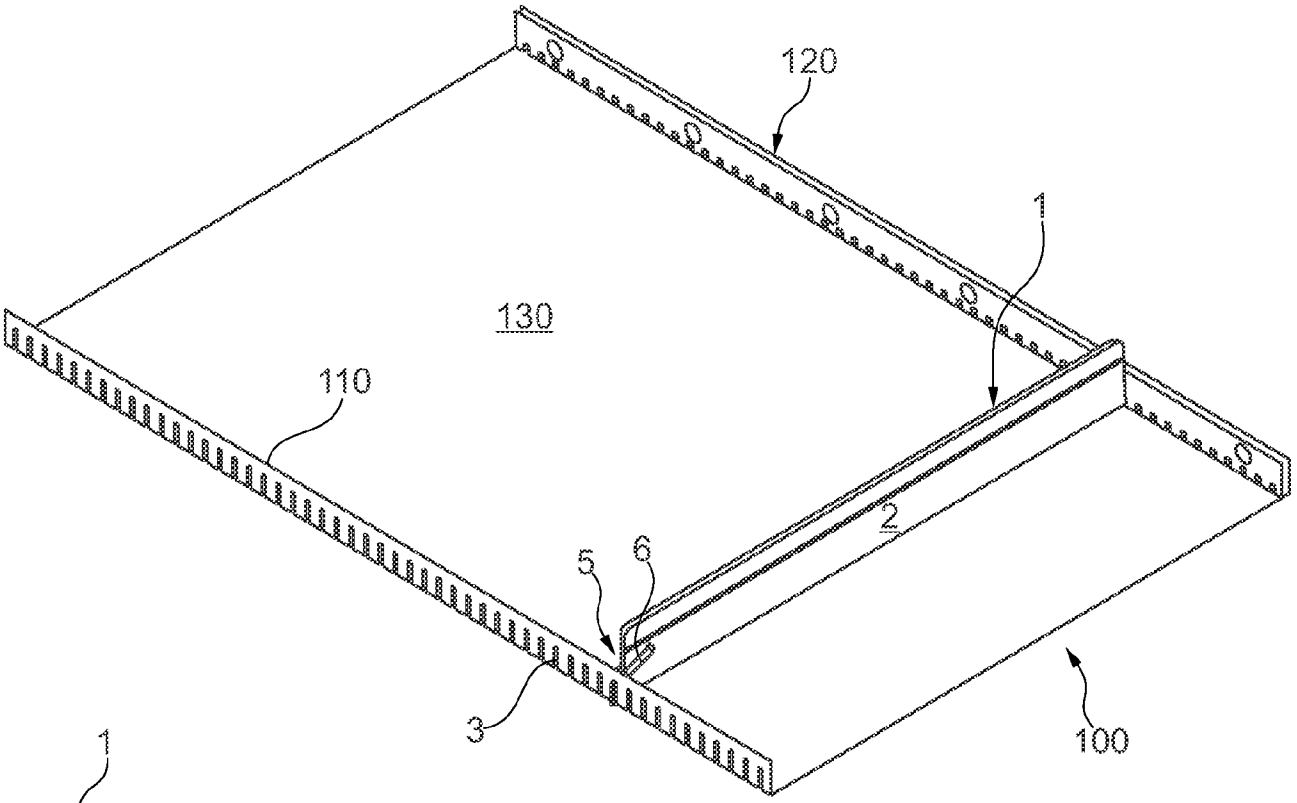
Figure 4B:
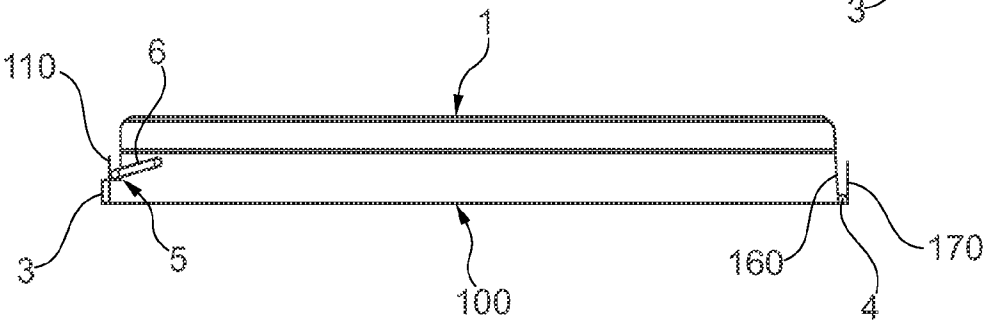

FIGS. 4A and 4B show the product divider 1 on the tray 100 in the final installed position in which the product divider 1 is on the tray 100 in the fixed position and the latching element 6 has assumed its locked position S.

Dismantling the product divider 1 from the tray 100 is possible in a simple manner in that the above-mentioned steps are carried out in the reverse order.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMERALS

1 product divider
2 main body
3 material section
4 material section
5 locking means
6 latching element
7 space
8 passage opening
9 end face
10 end face
11 end section
12 end section
100 tray
110 side wall
120 side wall
130 bottom
140 first opening
150 second opening
140' openings
150' openings
160 inner side wall
170 outer side wall
L length
F fixed position of the product divider
A starting position of the latching element
S latched position of the latching element

The invention claimed is:

1. A shelf unit, comprising:

a tray comprising:

a bottom; and first and second side walls, wherein the first and second side walls are disposed opposite one another at the bottom, the first and second side walls extending vertically upward from the bottom, wherein the first side wall includes a first plurality of openings and the second side wall includes a second plurality of openings;

a product divider comprising:

a main body configured to separate one or more products disposed on the shelf unit, the main body including at opposing ends of the main body a first end face and a second end face, a first material section that projects outwards from the first end face, and a second material section that projects outwards from the second end face, wherein the first material section is configured to be inserted into at least one opening of the first plurality of openings and the second material section is configured to be inserted into at least one opening of the second plurality of openings so as to hold the product divider in a fixed position on the tray by inserting both the first material section and the second material section; and a locking element configured to lock the product divider in the fixed position, the locking element being disposed closer to the first material section than the second material section, wherein the locking element comprises a latching element that is rotatably mounted on the product divider, and wherein the latching element is configured to rotate from a starting position into a locked position in a space formed between the main body of the product divider and the first side wall when the product divider is in the fixed position so as to lock the product divider onto the tray, wherein an outward-facing length of the first material section is greater than an outward-facing length of the second material section such that the first material section remains inserted in the at least one opening of the first plurality of openings when the second material section is disposed in the at least one opening of the second plurality of openings.

2. The shelf unit of claim 1, wherein the locking element is configured to engage a space that, in the fixed position of the product divider, is formed between the main body of the product divider and the first side wall.

3. The shelf unit of claim 1, wherein the latching element is configured so that in the locked position the latching element is in contact with (i) one of the material sections, (ii) one of the end faces, or (iii) one of the material sections and one of the end faces.

4. The shelf unit of claim 1, wherein the material sections are shaped onto the main body.

5. The shelf unit of claim 1, wherein the material sections are configured differently from each other in cross section shape, cross section surface area, or cross section shape and surface area.

6. The shelf unit of claim 1, wherein the first material section has an essentially rectangular cross section, such that the first material section can be inserted into the at least one opening of the first plurality of openings, the at least one opening of the first plurality of openings having an angular configuration.

7. The shelf unit of claim 1, wherein the divider has an elongated shape, wherein the first end face is disposed on a first end section of the divider and the second end face is disposed on a second end section of the divider, and wherein the first and second end sections face the bottom of the tray.

8. The shelf unit of claim 1, wherein the product divider has a plate-like configuration.

9. The shelf unit of claim 1, comprising:

a plurality of product dividers mounted on the tray.

10. The shelf unit of claim 1, wherein the material sections are shaped onto the main body by removing material from a blank that forms the main body.

11. The shelf unit of claim 1, wherein the material sections are shaped onto the main body by separating material from a blank that forms the main body.

12. The shelf unit of claim 1, wherein the material sections are configured differently from each other in cross section shape.

13. The shelf unit of claim 1, wherein the material sections are configured differently from each other in cross section surface area.

14. The shelf unit of claim 1, wherein the material sections are configured differently from each other in cross section shape and cross section surface area.

15. The shelf unit of claim 1, wherein the first material section has a rectangular cross section.

16. The shelf unit of claim 1, wherein the first material section has a square cross section.

17. The shelf unit of claim 1, wherein the at least one opening of the first plurality of openings has a slot-shaped configuration.

* * * * *